United States Patent [19]

Gold

[11] 4,401,949

[45] Aug. 30, 1983

[54] EXTERNAL DEVICE IDENTIFICATION SYSTEM

[75] Inventor: Kenneth S. Gold, Canoga Park, Calif.

[73] Assignee: FMC Corporation, Chicago, Ill.

[21] Appl. No.: 230,192

[22] Filed: Feb. 2, 1981

[51] Int. Cl.[3] ..... F02P 17/00

[52] U.S. Cl. ..... 324/402; 324/62; 324/73 AT; 364/551

[58] Field of Search ..... 324/402, 378, 384, 62, 324/73 AT; 340/510, 653, 661; 364/551; 339/113 R, 113 L

[56] References Cited

U.S. PATENT DOCUMENTS

| | | | |
|---|---|---|---|
| 3,458,806 | 7/1969 | Snow | 324/62 X |
| 3,464,001 | 8/1969 | Dodson | 324/62 X |
| 4,270,174 | 5/1981 | Karlin et al. | 324/378 X |
| 4,337,515 | 6/1982 | Kraft | 324/402 X |

*Primary Examiner*—Stanley T. Krawczewicz

*Attorney, Agent, or Firm*—H. M. Stanley; R. B. Megley

[57] ABSTRACT

An identification circuit for use in conjunction with an automobile engine analyzer system having a plurality of external probes is disclosed. The various probes and other external devices associated with the automobile engine analyzer each include a passive circuit element, typically a resistor. When the probe or other external device is connected to the analyzer, the passive circuit element completes the identification circuit within the analyzer. By applying a predetermined signal to the circuit, the particular probe or device connected may be identified by examining a particular circuit characteristic, such as the voltage drop across a second resistor of known resistance within the circuit.

5 Claims, 4 Drawing Figures

EXTERNAL DEVICE IDENTIFICATION SYSTEM

BACKGROUND OF THE INVENTION

1. Field of the Invention

The present invention relates generally to engine analyzers having inputs from more than one remote device. More particularly, it relates to a circuit for automatically distinguishing among such remote devices.

2. Description of the Prior Art

As a result of both revolutionary advances in microelectronics and increased concern over automotive emissions, engine analyzers have become increasingly complex over the past several years. The latest generation of engine analyzers typically includes a number of input probes which connect to various parts of the engine and exhaust system to collect data, a microprocessor for analyzing the data gathered, and various input/output (I/O) devices for communicating with the user. The probes may include units for magnetic timing, for measuring current, for measuring pressure, for infrared analysis of the vehicle exhaust, and the like. The I/O devices may include keyboards, cathode-ray tubes, printers, teletypes, and the like.

With the large number of diagnostic probes now available for engine analyzers and the probability that new probes will be available in the future, it is common that the various probes be attached to the analyzer through one or more common connectors only when required by the particular diagnostic test being performed. A serious problem arises when the user connects the improper probe for the analysis desired. In most cases, the results of the analysis would so deviate from the expected that the user would realize his mistake. In the worst case, however, the information generated by the analyzer, while incorrect, would be within a reasonable range and the user would never know his mistake. For this reason, it is desirable that the analyzer be able to distinguish from among the various probes which might be connected thereto.

Similarly, the engine analyzer will be capable of operating with different I/O devices, any of which might be connected to the analyzer at a given time. It is desirable that the analyzer be able to identify which I/O device is connected to the analyzer and interface with that device in the appropriate manner.

SUMMARY OF THE INVENTION

The aforementioned problems are overcome by supplying passive circuitry within each external device which uniquely identifies said external device to the engine analyzer. The engine analyzer includes circuitry supervised by the microprocessor, said circuitry being capable of identifying the passive circuit elements located in the particular external device connected to the analyzer.

The passive circuit elements located in the external device may be any element or elements having an identifiable response when a preselected voltage is applied thereto. In the simplest embodiment of the invention, the resistance value of a single resistor in the remote device is identified by associated circuitry in the analyzer. In a more sophisticated embodiment, two resistors in a parallel network are placed in the external device. Each resistor, in turn, is in series with a diode and the diodes are arranged so that current will flow through only one resistor when a voltage is applied to the network. By reversing the polarity of the voltage, current flows through the other resistor. In this way, the resistance of the first resistor is measured when the circuit polarity is in a first state, and the resistance of the second resistor is measured when the polarity of the voltage is in the opposite state. The remote device may then be identified by the unique combination of resistors.

A means is provided within the analyzer to apply a preselected voltage across the passive circuit element or elements of the remote device. In both embodiments described, a single resistor of known resistance is placed in series with the unknown resistor or resistors in the remote device. The unknown resistance or resistances are then determined by measuring the voltage drop across the known resistor using the concept of a voltage divider circuit.

DESCRIPTION OF THE PREFERRED EMBODIMENT

The preferred embodiment of this invention will be described with reference to an automobile engine analyzer comprising a central test stand and a number of remote engine probes which connect to the analyzer. Such engine probes are dedicated to specific tasks such as magnetic timing, measuring current, measuring exhaust emissions, and the like, and are connected to the central test stand when required by the particular diagnostic test being performed.

Figure 1:
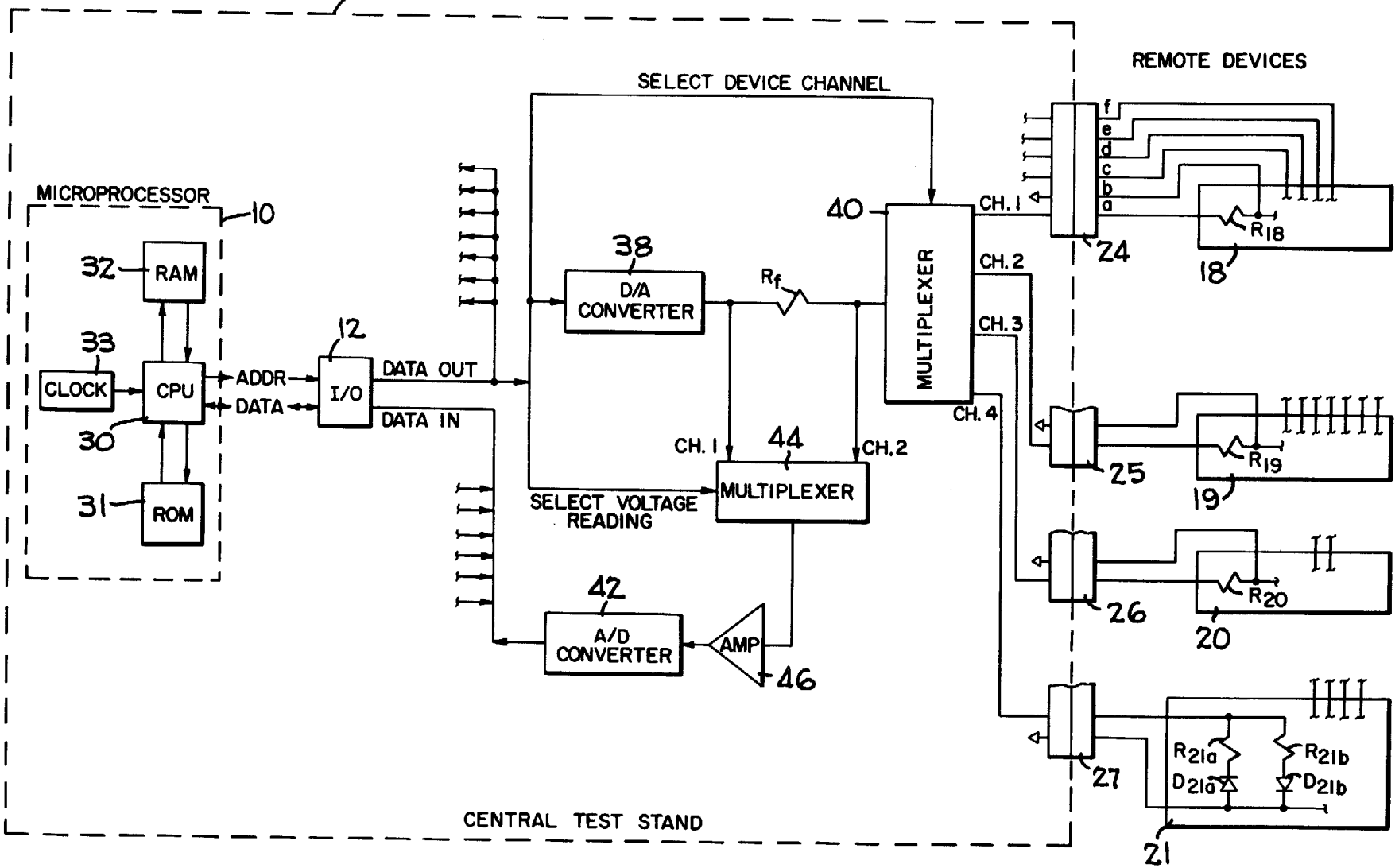
FIG. 1 is a circuit diagram illustrating the circuit components of the present invention.

Referring to FIG. 1, the central test stand includes a microprocessor 10, an I/O bus 12, and associated circuitry necessary to process the signals received from the remote probes. The purpose of the central test stand is to receive the signals generated by the remote probes, evaluate this information and inform the user of the necessary action to improve engine performance.

Referring still to FIG. 1, the bounds of the central test stand are indicated by broken line 14. All components shown within the line 14 are located on the central test stand. Probes 18, 19, 20 and 21 are remote from the central test stand and illustrated outside the boundary of line 14. The probes 18, 19, 20 and 21 may represent any of various diagnostic probes commonly associated with an engine analyzer. While only four probes are illustrated, there typically will be many additional probes associated with the analyzer which are not connected thereto at any given time.

Each of the external probes associated with the analyzer may be connected to the circuitry of the central test stand through one or more common connectors. As illustrated, probe 18 is connected through a connector 24, probe 19 through a connector 25, probe 20 through a connector 26, and probe 21 through a connector 27. The connectors are each ordinary, multiple-pin electrical connectors comprising a male half mounted on a cable lead to the probe and a female half mounted on the central test stand. Each connector may have any number of pins, although a minimum of three pins is required since the identification circuit of the present invention requires two pins and a third pin is necessary to carry information back from the probe. It is desirable to use connectors that have the same configuration and number of pins so that probes may be connected to any of the female connectors on the test stand and so that the number of spare parts is reduced.

Connector 24 is shown to have six lead wires a–f from probe 18. Only leads a and b are involved in the present invention, and the remainder of the connections would be used to transmit data relevant to the engine's performance. Note that lead b is a common ground for all leads in probe 18. Only the two lead wires involved in the identification circuit of the present invention are illustrated for each of the remaining probes 25–27, but it should be understood that additional connections would be necessary to transmit the diagnostic information gathered by each of said probes.

The central test stand includes the microprocessor 10 which coordinates all test functions of the analyzer. The microprocessor may be any of several conventional mircoprocessors which include a central processing unit (CPU) 30, a read only memory (ROM) 31, a random access memory (RAM) 32 and a clock 33. The utilization of a microprocessor to control test circuitry is well known in the prior art and will not be described except as it relates to the identification circuit of the present invention.

It is necessary that the CPU 30 be able to ascertain which device is connected to each of the input connectors. To accomplish this objective, the CPU 30 generates a number which is directed to a digital-to-analog (D/A) converter 38. The D/A converter 38 produces a voltage which is fed across a resistor $R_f$ into a multiplexer 40 having a single input channel and four output channels. The multiplexer 40 is able to direct the voltage produced by the D/A converter 38 to any one of the four connectors 24–27, as selected by the CPU. When a probe is in the connector thus selected by the CPU, a circuit, including resistor $R_f$ in series with one or more resistors located in the probe, is completed. The voltage drop across $R_f$ allows the probe to be identified in the manner described fully hereinafter.

An analog-to-digital (A/D) converter 42 is provided to read the voltage at either of two points in the identification circuit. The first point lies between the D/A converter 38 and resistor $R_f$. The second point lies between the resistor $R_f$ and the multiplexer 40. Both of these voltage signals are fed into a second multiplexer 44 having two inputs and a single output through an amplifier 46 provided to buffer the A/D converter from the voltages. Thus, the CPU is able to selectively read either the voltage output of the D/A converter 38 or the voltage drop across resistor $R_f$.

Multiplexer 40 has the capability of selectively directing the input voltage from resistor $R_f$ to any one of four output channels CH1, CH2, CH3, and CH4. CH1 is connected to pin a of connector 24. Similarly, CH2 is connected to a pin on connector 25; CH3 is connected to a pin on connector 26; and CH4 is connected to a pin on connector 27.

Device 18 is shown to have six lead wires between said device and the connector 24. The lead wire from pin a is connected to a resistor $R_{18}$ mounted within the device 18. Pin b is a common ground for the device 18 and is connected to the other side of $R_{18}$. It will be appreciated, therefore, that the microprocessor 10 may direct a voltage across $R_{18}$ by selecting CH1 of the multiplexer 40. Similarly, device 19 has a resistor $R_{19}$ connected across the two appropriate pins of connector 19. A voltage may be induced across resistor $R_{19}$ by selecting CH2 of the multiplexer 40. Device 20 is the same in this respect.

Instead of a single resistor, as with the previously described devices, device 21 contains a pair of resistors $R_{21a}$ and $R_{21b}$ each connected in series with a diode, $D_{21a}$ and $D_{21b}$, respectively. The resistor and diode pairs are connected in parallel across two pins of connector 27, and the microprocessor 10 is able to induce a voltage across the parallel resistors by selecting channel 4 of the multiplexer 40. It should be noted that the two diodes $D_{21a}$ and $D_{21b}$ are connected oppositely from each other. Thus, when a positive voltage is applied across the appropriate terminals of connector 27, current flow will proceed almost entirely through $R_{21a}$ while $D_{21b}$ blocks current flow through $R_{21b}$. When a negative voltage is applied, current flows largely through $R_{21b}$ while $D_{21a}$ blocks current flow through $R_{21a}$.

Figure 2:
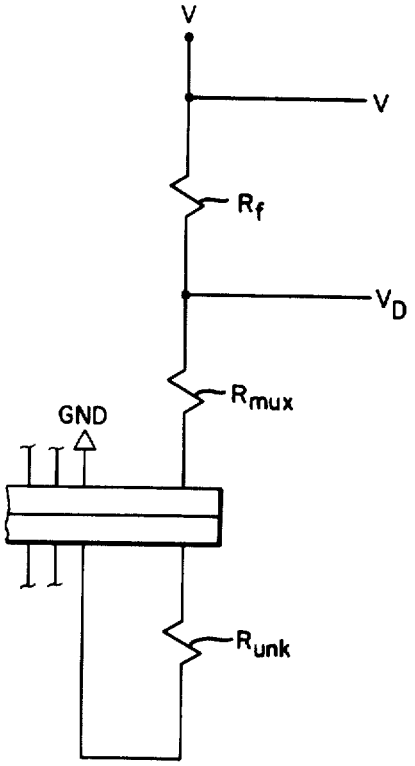
FIG. 2 is a simplified circuit diagram illustrating the use of a single resistor in the remote device.

The circuitry of the present invention acts as a voltage divider circuit, and, by measuring the voltage drop across $R_f$, it is possible to measure the resistance across the unknown resistor (or resistors) in the device connected to the central test stand. FIG. 2, illustrates the concept of the present invention for a device having a single identification resistor. A voltage V is applied by the D/A converter 38, as described hereinbefore. The resistor $R_f$ is chosen to be a 10K ohm resistor with an accuracy of plus or minus 1 percent. The multiplexer 40 in the circuit adds a second resistance $R_{mux}$ in series with $R_f$ having a value in the range from 50 to 500 ohms. The circuit is completed by a third resistor $R_{unk}$ mounted in the device connected to the central test stand. The "unknown" resistor $R_{unk}$ has a resistance value uniquely associated with each type of external device associated with the engine analyzer. The value of the resistor is unknown only in the sense that any of several probes might be connected to the central test stand at each of the connection points.

Once the identification circuit is completed by inserting a probe lead into the connector on the central test stand, the circuit consists essentially of three resistors in series with the values of two of such resistors known. Thus, the value of the third resistor, $R_{unk}$, may be determined by the well-known formula:

$$R_{unk}=(V_D R_{mux}+V_D R_f-VR_{mux})/(V-V_D)$$

where the resistance and voltage values are as shown in FIG. 2. Of course, the above formula assumes that the resistance value of each resistor is precisely equal to the nominal value thereof. This will probably not be the case. The internal resistance ($R_{mux}$) of the multiplexer 40 may vary by 450 ohms in addition to the 100 ohm variance found in $R_f$. For this reason, it is necessary that the values of $R_{unk}$ be chosen far enough apart so that the values determined for $R_{unk}$ will indeed be unique. The following ten normal values have been found satisfactory.

0 ohms (short circuit)
2.94K ohms
7.15K ohms
13.0K ohms
22.1K ohms
36.5K ohms
60.4K ohms
107K ohms 232K ohms ∞ ohms (open circuit)

Figure 3:
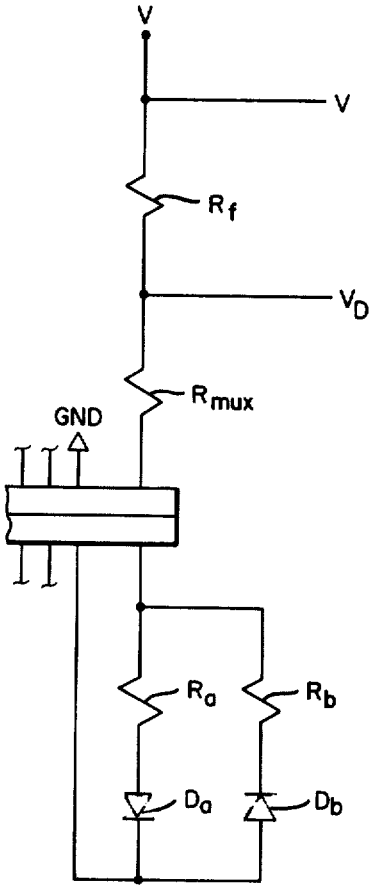
FIG. 3 is a simplified circuit diagram illustrating the use of a resistance network in the remote device.

Thus, by supplying a single resistor in the external device, it is possible for the engine analyzer to distinguish between 10 external devices at each of its connectors. To increase the number of distinguishable devices to 100, while using the same ten resistor values listed above, the circuit of FIG. 3 is used. The circuitry within the central test stand is identical to that used in conjunction with the circuit of FIG. 2 (as illustrated in FIG. 1). The only difference is found in the external device where two resistors $R_a$ and $R_b$, each having a predetermined resistance value, are connected in paralled across the voltage supplied by the central test stand. Each resistor $R_a$ and $R_b$ is connected in series with a diode $D_a$ and $D_b$, respectively, as previously pointed out. The circuitry of FIG. 3 is that shown in device 21 of FIG. 1. By first placing a positive voltage across the terminals of the connector, current flows through $R_a$ and the voltage divider circuit may be used to measure the value of the resistor $R_a$. Similarly, when a negative voltage is applied across the connector terminals, the voltage divider circuit will measure the resistor $R_b$. By then comparing both values against a table of stored values, it is possible to distinguish from among 100 (i.e., $10^2$) possible external devices.

Figure 4:
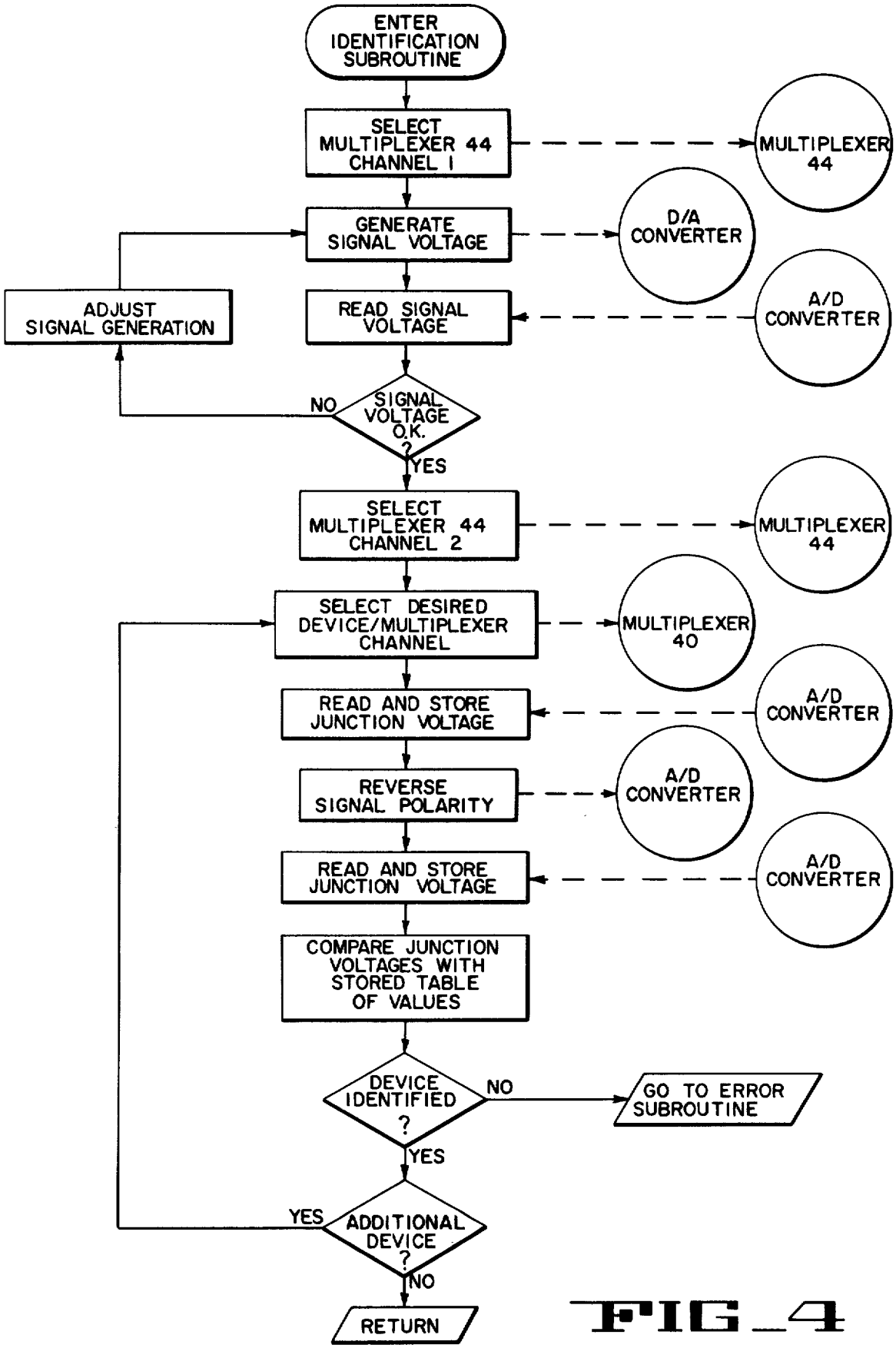
FIG. 4 is a flow chart illustrating the programming of the CPU of the present invention.

Referring to FIG. 4, the programming of the microprocessor 10 will be explained in detail. The executive program of the microprocessor 10 will enter the identification subroutine whenever it is necessary to ascertain which external devices, if any, are connected to each of the connectors on the central test stand. For example, if the user has informed the engine analyzer that he wishes to perform timing on a particular type of automibile, the microprocessor 10 will check to see that the appropriate timing probe has been connected to the central test stand.

The identification subroutine begins by selecting channel 1 of the multiplexer 44. The program next instructs the microprocessor 10 to send a digital number to the D/A converter 38, said number corresponding to a preselected voltage, typically 5 volts. The output voltage of the D/A converter 38 is then checked by examining CH1 of the A/D converter 42. The program compares the value of the voltage read on CH1 to the desired value and, if the value is not acceptable, adjusts the number generated by the microprocessor as necessary to gain an acceptable voltage. The program will continue to check the output voltage and adjust the number generated until the proper voltage has been attained.

After the proper voltage has been attained from the D/A converter 38, the microprocessor 10 instructs the multiplexer 44 to output channel 2, corresponding to the generated voltage V minus the voltage drop across $R_f$. The microprocessor 10 next instructs the multiplexer 40 which channel (i.e. which connector) it wishes to examine. After the desired channel has been selected, the voltage from multiplexer 40 is placed across the appropriate terminals of the selected connector. The voltage being read by the A/D converter 42 is the voltage generated by D/A converter 38 minus the voltage drop across $R_f$. As will be recalled, this value is uniquely associated with each of the 10 resistors which may be used to complete the circuit. This value is read and stored by the microprocessor 10. The microprocessor 10 next reverses the polarity of the output voltage from the D/A converter 38 so that a signal of the opposite polarity is placed across the connector pins on the connector selected. When the external device connected to the connector selected has only a single resistor, as in the circuit illustrated in FIG. 2, the voltage detected across $R_f$ by the A/D converter 42 will be the same regardless of polarity. However, when the external device carries two resistors, as illustrated in FIG. 3, the voltage $V_D$ detected will change when the polarity is reversed whenever the resistors $R_a$ and $R_b$ have different values. Since both $R_a$ and $R_b$ may have the ten values listed in Table 1 above, there is a total of 100 combinations of the resistor values. The program compares the two values identified with a table of stored values in memory to identify the particular device connected to the connector interrogated. If no combination is identified, the program enters an error subroutine. Once the first device is identified, additional devices may be identified as desired by looping back into the program to adjust the multiplexer 40. It will be appreciated that the loop may be entered as many times as necessary to identify each device connected to each one of the connectors, or until the desired device is located at any of several connectors. Once all devices have been identified, the executive program can check to see if all the appropriate devices have been connected to carry out the desired tests.

Although the best mode contemplated for carrying out the present invention has been herein shown and described, it should be understood that modification and variation may be made without departing from what is regarded to be the subject matter of the invention.

What is claimed is:

1. In an automobile engine analyzer having a central test stand, a plurality of types of external devices, and a common connector on said central test stand adapted to singly receive all types of external devices, a system for identifying which type of external device has been attached to the central test stand, said system comprising:

an element having a predetermined impedance value electrically accessible within each external device, the particular impedance value being the same for all external devices of a particular type and being different for different particular types;

means located on the central test stand for selective electrical connection with and evaluation of the impedance value within the particular type of external device which is connected to the central test stand through the common connector at any given time; and means for determining which particular type of device has been connected to the central test stand based on the value of impedance so determined.

2. A system as in claim 1, further comprising a means for informing a user of the automobile analyzer when the device connected to the central test stand is not the proper device for the test being performed at that time.

3. In an analyzer for automobile engines having a plurality of diagnostic probes which have data paths therein and which connect at different times to a common connector, a system for identifying which particular probe has been connected to the analyzer, said system comprising:

means for generating a preselected voltage signal within the system;

a first resistor connected to the means for generating a preselected voltage signal;

a probe identification path in each probe electrically accessible by the system, a plurality of second resistors, ones of said second resistors located within said probe identification path in each of the probes, individual ones of said probe identification paths being connected in series with the means for generating a preselected voltage signal and the first resistor so as to complete a circuit when the particular probe has been connected to the analyzer, and means for measuring the voltage drop across the first resistor, whereby the identity of the particular probe connected may be ascertained by reference to a table of unique values of voltage drops.

4. In an analyzer for automobile engines having a plurality of external devices which may connect at different times to a common connector on the analyzer, a system for identifying which particular device has been connected to the analyzer, said system comprising:

means for generating a preselected positive voltage and, alternatively, a preselected negative voltage;

a first resistor connected to the means for generating a preselected voltage;

a resistor network located within the particular probe which is connected to the system, said network being connected in series with the means for generating a preselected voltage and the first resistor and having a first resistance value when a positive voltage is applied and a second resistance value when a negative voltage is applied, and means for measuring the voltage drop across the first resistor both when the positive voltage is applied and when the negative voltage is applied, whereby two values are obtained the combination of which allows the identity of the probe to be obtained by reference to a predetermined table of combination values.

5. An analyzer according to claim 4, wherein the resistor network includes a second resistor in series with a first diode and, in parallel with the second resistor and first diode, a third resistor and a second diode, the first and second diodes being disposed so that substantially all current flows through the second resistor when a positive voltage is applied to the network while substantially all current flows through the third resistor when a negative voltage is applied to the network.

* * * * *